US006452079B2

(12) United States Patent
Sugiyama et al.

(10) Patent No.: US 6,452,079 B2
(45) Date of Patent: Sep. 17, 2002

(54) KEYBOARD MUSICAL INSTRUMENT EQUIPPED WITH HAMMER STOPPER PROMPTLY DRIVEN FOR ROTATION BY MEANS OF RIGID LINK WORK

(75) Inventors: Nobuo Sugiyama; Shigeaki Sato, both of Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/843,490

(22) Filed: Apr. 26, 2001

(30) Foreign Application Priority Data

Apr. 28, 2000 (JP) ..... 2000-130441

(51) Int. Cl.[7] ..... G10C 3/112
(52) U.S. Cl. ..... 84/423 R; 84/424; 84/425
(58) Field of Search ..... 84/423 R, 424, 84/425, 426, 645, 615

(56) References Cited

U.S. PATENT DOCUMENTS

| | | | | |
|---|---|---|---|---|
| 5,374,775 A | | 12/1994 | Kawamura et al. | |
| 5,428,186 A | * | 6/1995 | Kaneko et al. | 84/719 |
| 5,841,053 A | * | 11/1998 | Johnson et al. | 84/423 R |
| 5,880,389 A | * | 3/1999 | Muramatsu | 84/21 |
| 5,922,983 A | * | 7/1999 | Muramatsu | 84/615 |
| 6,245,985 B1 | * | 6/2001 | Sasaki et al. | 84/423 R |
| 6,380,469 B2 | * | 4/2002 | Uehara | 84/21 |

* cited by examiner

*Primary Examiner*—Robert E. Nappi
*Assistant Examiner*—Kim R. Lockett
(74) *Attorney, Agent, or Firm*—Morrison & Foerster LLP

(57) ABSTRACT

A composite keyboard musical instrument includes an acoustic grand piano, an electronic sound generating system and a silent system, and an electric motor, a hammer stopper, a link work and a controller form in combination the silent system, wherein rigid arms and rigid rods are assembled into the link work so as to promptly transmit the force from the actuator to the hammer stopper without substantial time lug.

28 Claims, 9 Drawing Sheets

KEYBOARD MUSICAL INSTRUMENT EQUIPPED WITH HAMMER STOPPER PROMPTLY DRIVEN FOR ROTATION BY MEANS OF RIGID LINK WORK

FIELD OF THE INVENTION

This invention relates to a keyboard musical instrument and, more particularly, to a composite keyboard musical instrument equipped with a hammer stopper for muting acoustic tones.

DESCRIPTION OF THE RELATED ART

An acoustic piano is equipped with an electronic sound generating system and a silent system, and is a kind of composite keyboard musical instrument for selectively generating electronic tones and acoustic tones. A hammer stopper is an essential part of the silent system. When an acoustic piano is retrofitted to the composite keyboard musical instrument, the hammer stopper is usually installed in the space between the hammer shanks and the music strings. The hammer stopper is changeable between a free position and a blocking position. When a pianist wishes to play a tune on the composite keyboard musical instrument through the acoustic tones, the hammer stopper is changed to the free position. The hammer stopper permits the hammers to strike the associated strings, and the strings generate the acoustic tones. On the other hand, if a pianist wishes to practice fingering on the keyboard without acoustic tones, the pianist changes the hammer stopper to the blocking position. Eve though the hammers are driven for rotation by the action mechanisms, the hammers rebound on the hammer stopper before striking the strings, and any acoustic tone is generated from the strings. The key action or the hammer action is monitored by an array of sensors, and electronic tones are generated by the electronic sound generating system. The pianist hears the electronic tones through a headphone, and records the pieces of music data information representative of the practice in a suitable information storage medium. Thus, the pianist can practice the fingering without disturbance of the neighborhood.

In the following description, term "lateral" is indicative of a direction in which black keys and white keys are laid on the well-known pattern, and term "fore-and-aft" is indicative of the direction perpendicular to the lateral direction. Term "front" is indicative of a position closer to a pianist who plays a tune on a composite keyboard musical instrument than a "rear" position.

FIGS. 1 and 2 show a typical example of the hammer stopper installed in an acoustic grand piano. The hammer stopper is designed to make the hammer shanks 1*a* to rebound thereon in the blocking position. The prior art hammer stopper largely comprises a shaft 2*a*, brackets 2*b* and laminations of artificial leather sheets 2*c*, and is connected through a link work 3 and a flexible wire 4 to a pedal (not shown). The shaft 2*a* laterally extends in the space between an array of hammers 1 and sets of strings 6, and is angularly movable about the center axis thereof. The brackets 2*b* are attached to the shaft 2*a* at intervals, and the artificial leather sheets 2*c* are laminated on the brackets 2*b*.

The link work 3 is turnable about the center axis of a pin 3*a*, and the flexible wire 4 is connected to the link work 3. The flexible wire 4 extends downwardly, and is terminated at the pedal (not shown). The pedal is supported by a lyre box (not shown) together with the other pedals, i.e. a damper pedal and a soft pedal. Otherwise, the flexible wire 4 extends frontward, and is terminated at a grip (not shown) attached to the back surface of the key bed (not shown). When the pianist changes the hammer stopper from the free position to the blocking position, he or she steps on the pedal, and pulls down the flexible wire 4. If the flexible wire 4 is terminated at the grip instead of the pedal, the pianist frontward pulls the flexible wire with the grip. The pianist is to move the pedal or the grip between the dead points. Then, the other end of the flexible wire 4 is downwardly moved, and the Link work 3 is driven for rotation about the center axis of the pin 3*a*. Accordingly, the shaft 2*a* is angularity moved about the center axis thereof. The laminations of artificial leather sheets 2*c* are out of the trajectories of the hammer shanks 1*a* in the free position as indicated by dots-and-dash line. When the hammer stopper 2 is changed from the free position to the blocking position, the laminations of artificial leather sheets 2*c* enter the trajectories of the associated hammer shanks 1*a* through the angular motion, and the laminations of artificial leather sheets 2 are opposed to the hammer shanks 1*a* as indicated by real lines in FIG. 1.

As known to the skilled person, black/white keys 7 are laid on the well-known pattern of keyboard, and notes of the scale are respectively assigned to the black/white keys 7. The notes are also assigned to the associated sets of strings 6, respectively. Action mechanisms 8 are provided between the black/white keys 7 and the hammers 1. The hammers 1 are rotatably connected to hammer shank flanges, which in turn are fixed to a shank flange rail. When a pianist wishes to generate a piano tone, he or she depresses the black/white key 1 assigned the note identical with the piano tone to be generated. The depressed key 7 gives rise to rotation of the action mechanisms, and the action mechanism 8 escapes from the associated hammer 1. When the action mechanism 8 escapes from the associated hammer 1, the hammer 1 is driven for rotation about the hammer shank flange. If the hammer stopper 2 is in the free position, the hammer 1 strikes the associated set of strings 6 with the hammer head 1*b*, and the piano tone is radiated from the vibrating strings 6. On the other hand, if the hammer stopper 2 has been changed to the blocking position, the hammer shank 1*a* is brought into contact with the lamination of artificial leather sheets 2 (see FIG. 3) before reaching the set of strings 6, and rebounds thereon.

Thus, the prior art silent system allows the pianist to play a tune on the keyboard through the acoustic tones or the electronic tones in so far as he or she surely moves the hammer stopper 2 between the dead points. However, if the pianist stops the pedal or grip at an intermediate point between the dead points, the hammers 1 are liable to damage the hammer stopper 2 or be damaged at the impact against the hammer stopper 2.

In case where the pianist changes the hammer stopper 2 from the free position to the blocking position before the performance, he or she can concentrate his or her attention on the manipulation of the pedal/grip. However, when the pianist changes the acoustic tones to the electronic tones during the performance, he or she is to manipulate the pedal or grip concurrently with the fingering on the keyboard. If the pianist proceeds to complicated music passage during the manipulation, he or she tends to have his or her attention distracted, and is liable to stop the pedal or grip an intermediate point between the dead points.

Another problem is poor manipulability of the hammer stopper 2 due to a time lug between the manipulation of the pedal or grip and the completion of the angular motion. As described hereinbefore, the flexible wire 4 interconnects the link work 3 and the pedal or grip. The link work 3 is provided over the rear portions of the black/white keys 7, and the pedal or grip is located at the lyre box or immediately under the keyboard. Therefore, the flexible wire 4 is not short. When the pianist exerts tension on the flexible wire 4 by means of the pedal or grip, the flexible wire 4 is elastically deformed, and, thereafter, slides in the guide tube. The elastic deformation introduces the time lug into the power transmission from the pedal or grip to the link work 3. The pianist has to take the time lug into account. In other words, when the pianist wishes to change the hammer stopper 2 from the free position to the blocking position, he or she is to initiate the manipulation of the pedal or grip before the first note to be electronically generated. However, it is quite difficult exactly to adjust the change to the blocking position to the first note. In an actual performance, it is recommended for the pianist to change the hammer stopper in a relatively long rest in a music score.

SUMMARY OF THE INVENTION

It is therefore an important object of the present invention to provide a composite keyboard musical instrument, the silent system of which is promptly responsive to user's manipulation.

In accordance with one aspect of the present invention, there is provided a keyboard musical instrument comprises an acoustic keyboard musical instrument including a keyboard consisting of plural keys, plural vibratory members vibrating for generating acoustic tones respectively assigned notes of a scale, plural vibration generating mechanisms respectively provided between the plural keys and the plural vibratory members and responsive to motions of the plural keys for generating vibrations in the plural vibratory members and a case accommodating the plural vibratory members and the plural vibration generating mechanisms and providing the keyboard to a player, and a silent system including an actuator generating a power, a stopper changed between a free position for allowing the plural vibration generating mechanisms to generate the vibrations in the plural vibratory members and a blocking position for preventing the plural vibratory members from the plural vibration generating mechanisms and an interconnection connected between the actuator and the stopper and rigid against the power so as to promptly transmit the power from the actuator to the stopper without substantial deformation thereof.

In accordance with another aspect of the present invention, there is provided a keyboard musical instrument comprises an acoustic keyboard musical instrument including a keyboard consisting of plural keys, plural vibratory members vibrating for generating acoustic tones respectively assigned notes of a scale, plural vibration generating mechanisms respectively provided between the plural keys and the plural vibratory members and responsive to motions of the plural keys for generating vibrations in the plural vibratory members and a case accommodating the plural vibratory members and the plural vibration generating mechanisms and providing the keyboard to a player, and a muting system including an actuator generating a power, a stopper changed between a free position for allowing the plural vibration generating mechanisms to generate the vibrations in the plural vibratory members and a muting position for reducing forces exerted on the plural vibratory members by the plural vibration generating mechanisms and an interconnection connected between the actuator and the stopper and rigid against the power so as to promptly transmit the power from the actuator to the stopper without substantial deformation thereof.

BRIEF DESCRIPTION OF THE DRAWINGS

The features and advantages of the composite keyboard musical instrument will be more clearly understood from the following description taken in conjunction with the accompanying drawings in which.

DESCRIPTION OF THE PREFERRED EMBODIMENTS

First Embodiment

Figure 1:
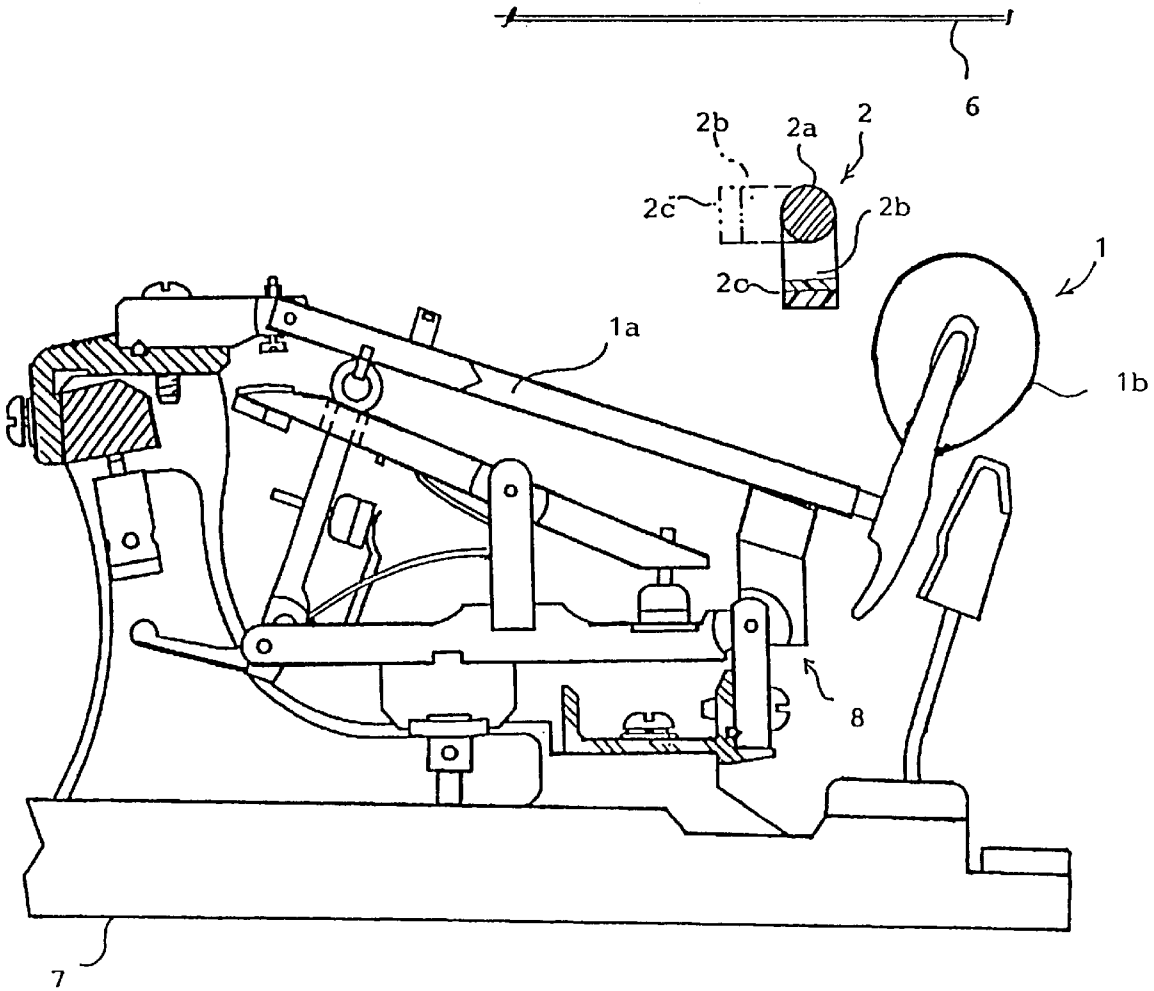
Fig. 1 PRIOR ART
FIG. 1 is a side view showing the prior art hammer stopper installed in the acoustic grand piano.
Figure 2:
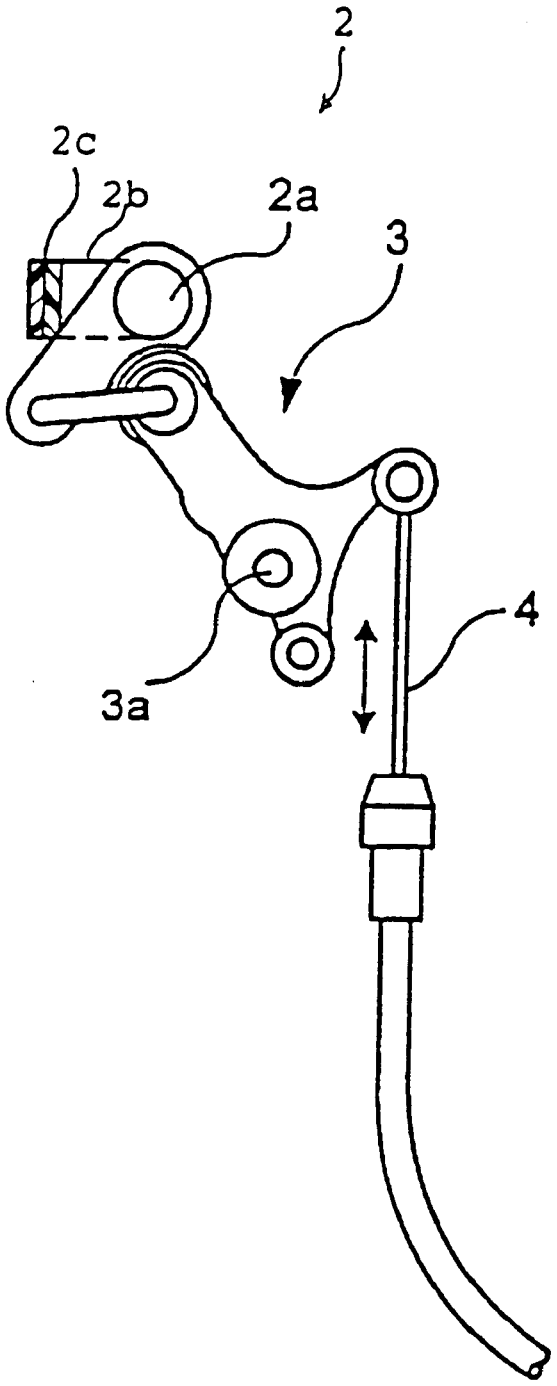
Fig. 2 PRIOR ART
FIG. 2 is a side view showing the link work incorporated in the prior art hammer stopper.
Figure 3:
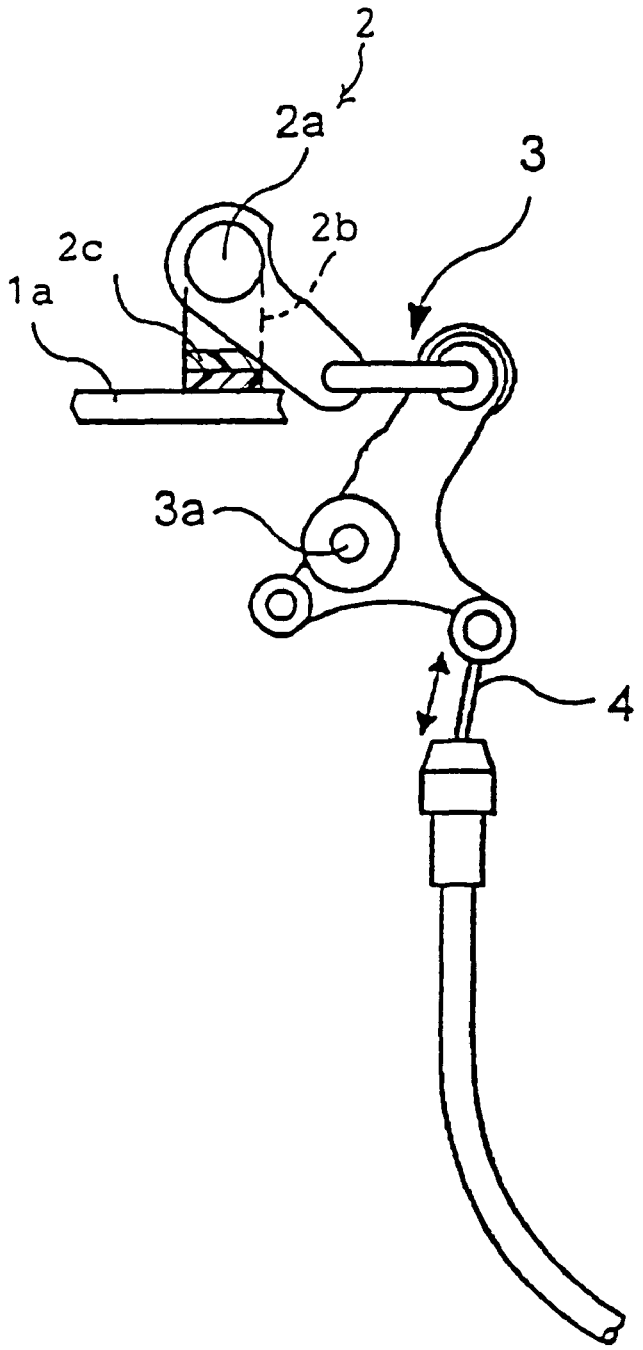
Fig. 3 PRIOR ART
FIG. 3 is a side view showing the prior art hammer stopper changed to the blocking position through the angular motion of the link work.
Figure 4:
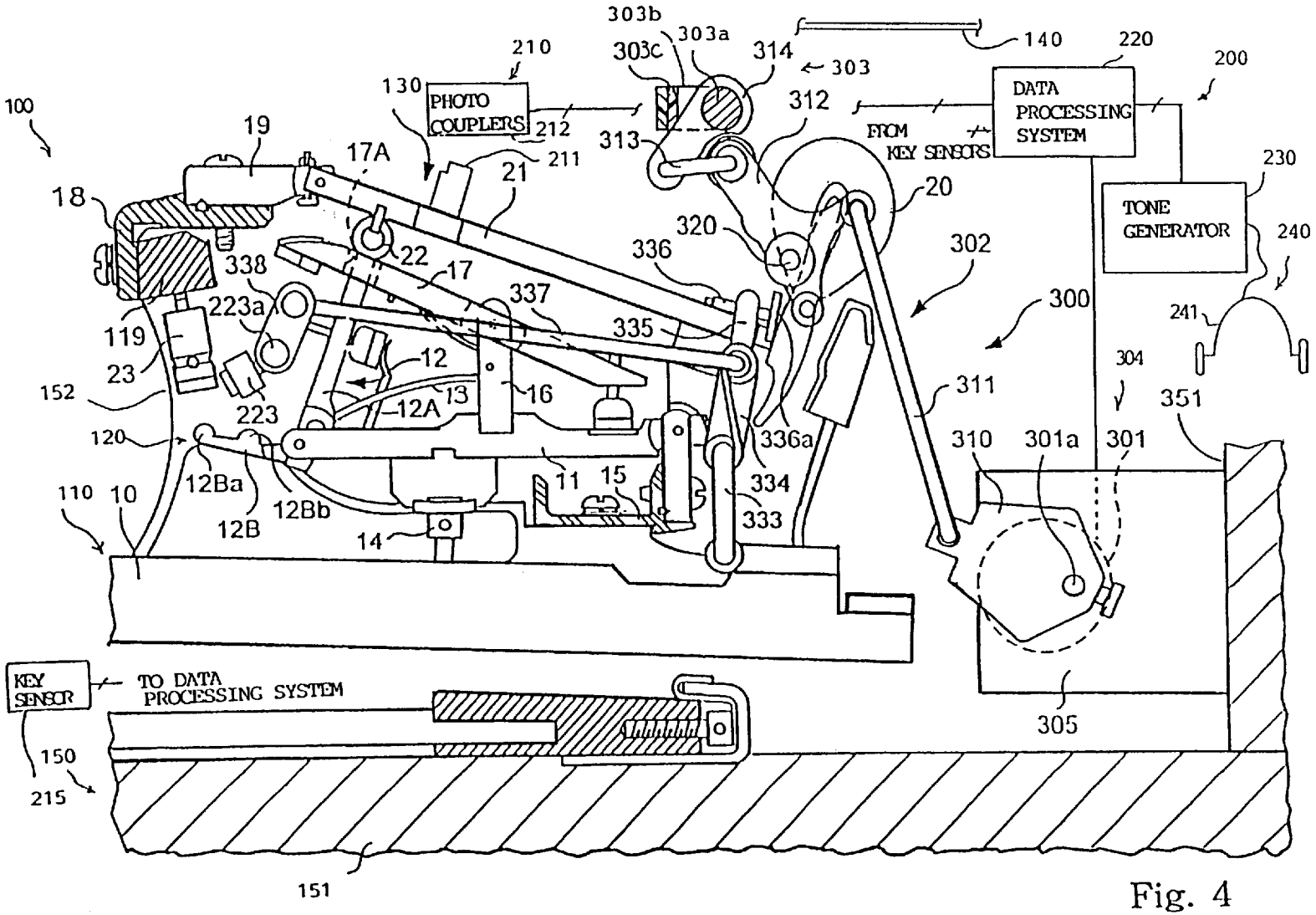
FIG. 4 is a side view showing an essential part of a composite keyboard musical instrument according to the present invention.

Referring to FIG. 4 of the drawings, a composite keyboard musical instrument embodying the present invention largely comprises an acoustic grand piano 100, an electronic sound generating system 200 and a silent system 300. The acoustic grand piano 100 generates acoustic tones in response to a finger work of a pianist. The electronic sound generating system 200 is installed in the acoustic grand piano 100, and generates electronic tones also in response to the finger work of the pianist. The silent system 300 is also installed in the acoustic grand piano 100, and the pianist selects the acoustic tones or the electronic tones by means of the silent system 300. The acoustic piano 100, the electronic sound generating system 200 and the silent system 300 are hereinbelow described in detail.

The acoustic grand piano 100 comprises a keyboard 110, action mechanisms 120, hammers 130, sets of strings 140, dampers (not shown) and a piano case 150. A key bed 151 forms a part of the piano case 150, and the keyboard 110 is mounted on the key bed 151 so as to be exposed to the pianist. The action mechanisms 120, the hammers 130, the sets of strings 140 and the dampers 150 are accommodated in the piano case 150. The sets of strings 140 are stretched over the rear portion of the keyboard 110, and the action mechanisms 120 and the hammers 130 are provided in the space between the keyboard 110 and the sets of strings 140. The action mechanisms 120 are selectively actuated by the keyboard 110, and the associated hammers 130 are drive for rotation toward the sets of strings 140 by the actuated action mechanisms 120 through the escape.

Black keys and white keys are arranged in the lateral direction, and are laid on the well-known pattern. Each black/white key 10 is assigned one of the notes of the scale. Though not shown in FIG. 4, a balance rail is laterally extends over the key bed 151, and are in contact with intermediate portions of the black/white keys 10. A balance pin (not shown) keeps the black/white key 10 on the balance rail, and permits a pianist to give rise to rotation of the black/white key 10 around the balance rail. Capstan screws 14 project from the rear portions of the black/white keys 10, and the action mechanisms 120 exerts the self-weights on the capstan screws 14, respectively. For this reason, the black/white keys 10 are urged in the clockwise direction, and the front end portions of the black/white keys 10 are spaced from the front rail (not shown). When the pianist depresses the front end portion of a black/white key 10, the black/white key 10 is driven for rotation about the balance rail (not shown) in the counter clockwise direction, and the capstan screw 14 pushes the action mechanism 120 upwardly.

Action brackets 152 are respectively fixed to the upper surfaces of the bracket blocks (not shown), and the bracket blocks are provided on the key bed 151 at intervals in the lateral direction. A whippen rail 15 and a shank flange rail 18 are supported by the action brackets 152. The whippen rail 15 is shared between the action mechanisms 120, and the shank flange rail 18 is shared between the hammers 130.

The action mechanisms 120 are identical in structure with one another. Each of the action mechanisms 120 includes a whippen 11, a jack 12, a repetition spring 13, a repetition lever flange 16, a repetition lever 17 and a regulating button 23. The whippen 11 is rotatably connected at one end thereof to the whippen rail 120 by means of a whippen flange, and the jack 12 is rotatably connected to the other end of the whippen 11. A whippen heel projects from the lower surface of the whippen 11, and the capstan screw 14 is held in contact with the whippen heel. The repetition lever flange 16 is fixed to an intermediate portion of the whippen 11, and upwardly projects therefrom. The repetition lever 17 is rotatably connected to the repetition lever flange 16, and a through-hole 17A is formed in one end portion thereof. The jack 12 has a relatively long leg portion 12A and a relatively short foot portion 12B, and the relatively long leg portion 12A is substantially perpendicular to the relatively short foot portion 12B. The relatively long leg portion 12A is inserted into the through-hole 17A, and the jack 12 is rotatably supported at the corner thereof by the other end of the whippen 11. Toe 12B*a* is formed in the leading end of the relatively short foot portion 12B, and a bump 12B*b* is further formed in the relatively short foot portion 12B. The bump 12B*b* is closer to the corner than the toe 12B*a*. A regulating rail 119 is fixed to the shank flange rail 18, and the regulating button 23 is hung from the regulating rail 119. The regulating button 23 is opposed to the toe 12B*a*, and the gap between the regulating button 23 and the toe 12B*a* is regulable. The repetition spring 13 is provided between the jack 12 and the repetition lever 17, and appropriately urges the jack 12 and the repetition lever 17 so as to keep the respective home positions as shown. Thus, the above-described parts 11, 12, 13, 16, 17 and 23 are assembled in the structure of an action mechanism incorporated in a standard grand piano. Although other parts are further incorporated in the action mechanism 120, they are similar to those of the action mechanism, and are less important for understanding the present invention. For this reason, the other parts are not described for the sake of simplicity.

The hammers 130 are similar to one another. Each of the hammers 130 includes a hammer shank flange 19, a hammer head 20, a hammer shank flange 21 and a hammer roller 22. The hammer heads 20 are different in size depending upon the register to which the note assigned to the associated set of strings 140 belongs. The hammer shank flange 19 is bolted to the shank flange rail 18, and the hammer shank 21 is rotatably connected to the hammer shank flange 19. The hammer head 20 is fixed to the leading end of the hammer shank 21, and is located under the associated set of strings 140. The hammer roller 22 is attached to the hammer shank 21 in such a manner as to be in contact with the relatively long leg portion 12A. Thus, the action mechanism 120 is linked with the associated hammer 130 at the engagement between the jack 12 and the hammer roller 22.

The sets of strings 140 are respectively associated with the black/white keys 10, and generate the tones assigned the notes of the scale identical with those assigned to the black/white keys 10 through the vibrations. Although the dampers (not show) are provided in association with the sets of strings 140, the dampers are less important for understanding the present invention, and are not detailed hereinbelow.

Assuming now that the pianist depresses a black/white key 10, the black/white key 10 is moved from the rest position toward the end position, and gives rise to the rotation of the whippen 11 around the whippen flange in the clockwise direction. The jack 12 is also rotated around the whippen flange, and the toe 12B*a* is getting closer to the regulating button 23. When the toe 12B*a* is brought into contact with the regulating button 23, the regulating button 23 causes the jack 12 to turn around the whippen 11 in the counter clockwise direction. Then, the jack 12 escapes from the hammer roller 22, and gives rise to free rotation of the associated hammer 130 around the hammer shank flange 19. The hammer either strikes the associated set of strings 140 or rebound on the silent system.

The electronic sound generating system 200 comprises plural hammer sensors 210, plural key sensors 215, a data processing system 220, a tone generator 230 and a sound system 240. The plural hammer sensors 210 are respectively associated with the hammers 130, and produce hammer position signals representative of current positions of the associated hammers 130. In this instance, each of the hammer sensors 210 is implemented by a combination of a shutter plate 211 and photo-couplers 212. The shutter plate 211 is attached to the hammer shank 21 of the associated hammer 130, and, accordingly, is moved together with the associated hammer 130. The photo-couplers 212 are stationary with respect to the shank flange rail 18, and are arranged along the trajectory of the shutter plate 212. The photo-couplers 212 radiate light beams across the trajectory, and the light beams are sequentially interrupted by the shutter plate 211 so as to change the bit pattern of the hammer position signal. The hammer position signals are supplied from the hammer sensors 210 to the data processing system 220. The key sensors 215 are respectively associated with the black/white keys 10, and produce key position signals representative of current key position. The key position signals are also supplied to the data processing system 220.

The data processing system 220 includes a data processor, a working memory and a program memory. The data processor runs on a computer program for processing the pieces of data information representative of the current key positions and the pieces of data information representative of the current hammer positions. The data processor periodically scans the interfaces assigned to the hammer position signals and the key position signals to see whether or not any one of the black/white keys 10 changes the current position after the previous signal scanning.

When the pianist depresses a black/white key 10, the data processor notices the black/white key 10 change the current position, and specifies the black/white key 10 so as to register the black/white key 10 in a key table. The hammer sensor 210 detects the associated hammer 130 reaching the position immediately before the set of strings 140. The data processor determines the final hammer velocity or the loudness proportional to the final hammer velocity on the basis of the variation of the current position, and supplies a MIDI (Musical Instrument Digital Interface) message representative of the note-on for the piano tone at the loudness to the tone generator 230. The tone generator produces an audio signal in response to the MIDI message, and supplies the audio signal to the sound system 240. The sound system converts the audio signal to an electronic tone. The electronic tone may be produced through a headphone 241.

On the other hand, when the data processor notices the black/white key 10 passing a certain point on the way from the end position to the rest position, the data processor supplies another MIDI message representative of a note-off of the piano tone to the tone generator 230. The tone generator recovers the audio signal to the potential level representative of the silence, and the electronic tone is extinguished.

The silent system 300 includes into an actuator 301, a link work 302, a hammer stopper 303, a controller 304 and a second regulating button 223. In this instance, the actuator 301 is implemented by an electric motor. The electric motor 301 categorized in a geared motor. In the geared motor, the gear ratio is high enough to exhibit a large self-holding capability. For this reason, when the electric power is removed, the electric motor 301 keeps the output shaft 301*a* without any backward rotation. A bracket 305 is fixed to the front surface of a woody plate 351 upright on the key bed 151, and the electric motor 301 is supported by the bracket 305. The electric motor 301 bidirectionally rotates an output shaft 301*a* (see FIGS. 5 and 6), and the controller 304 sets a limit on the angular range of the rotation. The output shaft 301*a* is directed in the lateral direction.

The hammer stopper 303 includes a shaft 303*a*, brackets 303*b* and laminations of artificial leather sheets 303*c*. The shaft 303*a* laterally extends over the rear portions of the black/white keys 10, and is rotatably supported by suitable brackets 350*a* fixed to side boards 350 (see FIG. 7). The link work 302 is connected to the shaft 303*a* in the vicinity of the right side board 350. The electric motor 301 is also provided in the vicinity of the right side board 350. The arrangement is desirable, because the distance between the electric motor 301 and the hammer stopper 303 is decreased. Moreover, a worker easily assembles the silent system 300 in the right side portion of the rear zone over the key bed 151.

The brackets 303*b* are fixed to the shaft 303*a* at intervals in the lateral direction, and the laminations of artificial leather sheets 303*c* are attached to the brackets 303*b*. The hammer stopper 303 is changed between a blocking position and a free position through angular motion around the center axis of the shaft 303*a*. The hammer stopper 303 keeps the laminations of artificial leather sheets 303*c* out of the trajectories of the hammer shanks 21, and the hammer heads 20 are allowed to strike the sets of strings 140 without any interruption of the hammer stopper 303. The sets of strings 140 vibrate for generating the acoustic tones. Thus, the silent system 300 permits the pianist to play a tune through the acoustic piano tones. The performance through the acoustic piano tones is referred to as "acoustic sound mode".

When the hammer stopper 303 is changed to the blocking position, the laminations of artificial leather sheets 303*c* are directed to the hammer shanks 21, and enter the trajectories of the associated hammer shanks 21. After the escape, the hammers 130 start the free rotation toward the associated sets of strings 140. However, the hammer shanks 21 are brought into contact with the laminations of artificial leather sheets 303*c* before the strikes. The hammers 130 rebound on the hammer stopper 303, and return to the home positions. The sets of strings 140 do not vibrate for generating the acoustic piano tone. The electronic sound generating system 200 generates the electronic tones instead of the acoustic piano tones. Thus, the silent system 300 permits a pianist to practice the fingering without disturbance of neighborhood. The performance without the acoustic piano tone is hereinbelow referred to as "silent mode".

Figure 5:
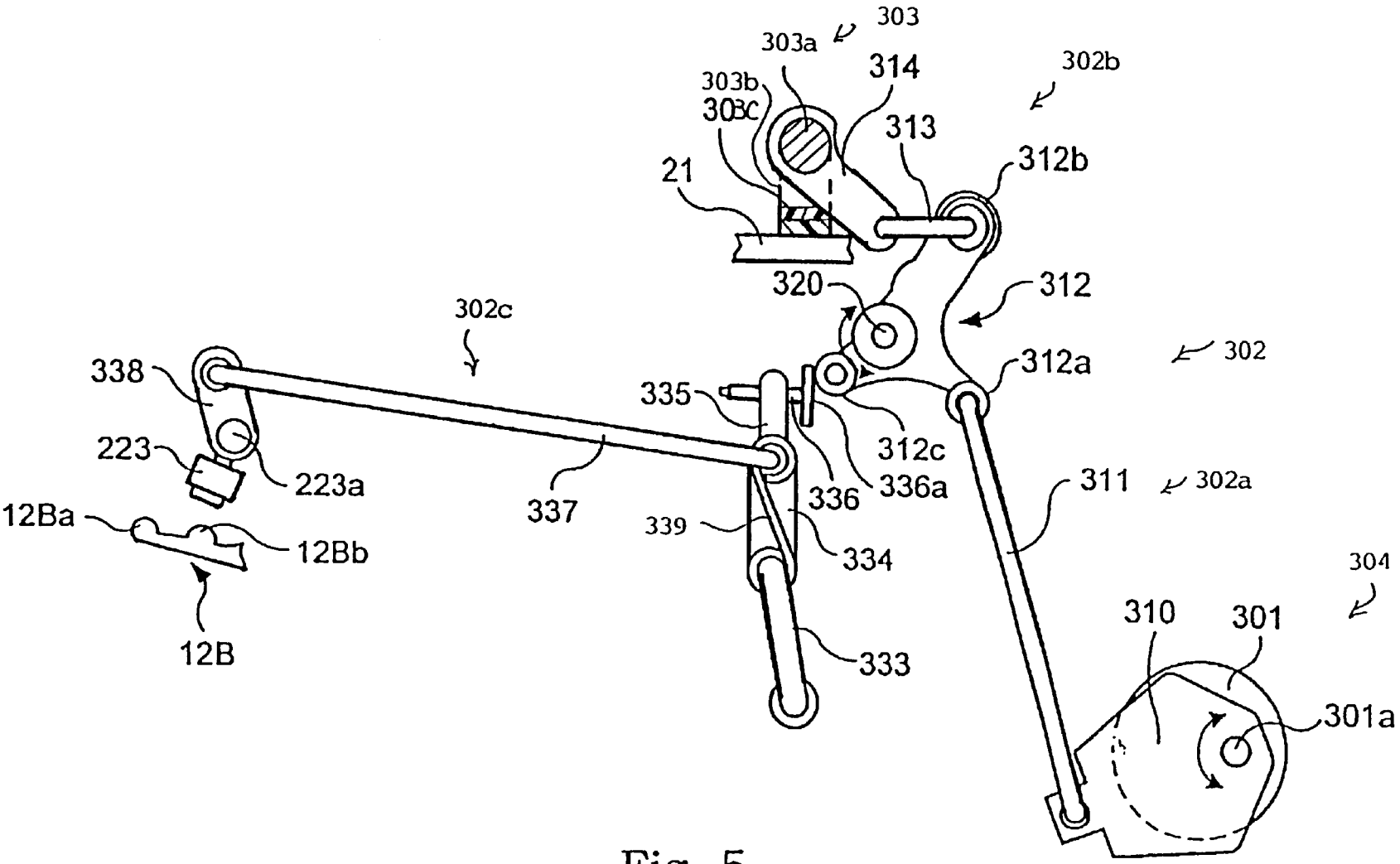
FIG. 5 is a side view showing the arrangement of a silent system incorporated in the composite keyboard musical instrument after entry into a blocking position.
Figure 6:
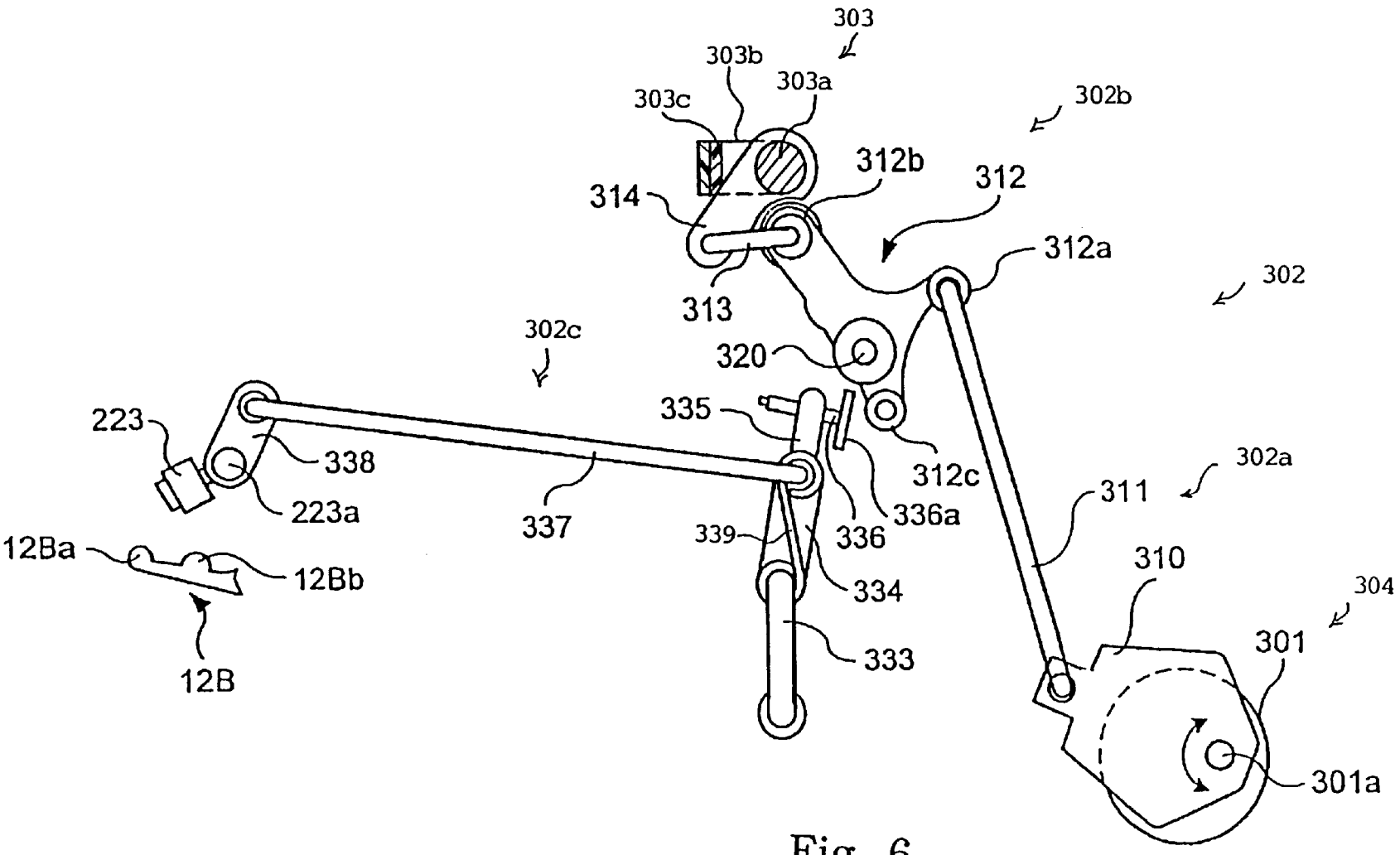
FIG. 6 is a side view showing the arrangement of a silent system incorporated in the composite keyboard musical instrument after a change to a free position.

As will be better seen in FIGS. 5 and 6, the link work 302 is broken down into a common link sub-work 302*a*, a link sub-work 302*b* for the hammer stopper 303 and a link sub-work 302*c* for the second regulating button 223. The common link sub-work 302*a* is shared between the hammer stopper 303 and the second regulating button 223, and is connected to the electric motor 301. The torque is transmitted from the electric motor 301 through the common link sub-work 302*a* to both of the link sub-works 302*b*/302*c*, and change the hammer stopper 303 between the free position and the blocking position and the second regulating button 223 between an active position (see FIG. 5) and an inactive position (see FIG. 6). The second regulating button 223 is connected to a shaft 223*a*, and the shaft 223*a* is driven for rotation by the link sub-work 302*c*. The second regulating button 223 is directed to the bump 12B*b* in the active position, and gives rise to the rotation of the jack 12 around the whippen 11. Then, the jack 12 escapes from the associated hammer 130. When the second regulating button 223 is changed to the inactive position, the second regulating button 223 is out of the trajectory of the bump 12B*b*, and the toe 12B*a* is brought into contact with the regulating button 23 before the bump 12B*b*. Thus, either toe 12B*a* or bump 12B*b* causes the jack 12 to escape from the associated hammer 130.

The common link sub-work 302*a* includes an arm 310, a connecting rod 311 and another arm 312. The bracket 305 is generally L-letter shape (see FIG. 7), and is located in the vicinity of the side board 350 on the right side of the key bed 151. The output shaft 301*a* projects through the bracket 305, and is fixed to the arm 310. The arm 310 has a regular pentagonal shape, and the output shaft 301*a* is offset from the centerline of the pentagonal arm 310. The connecting rod 311 is turnably connected to the pentagonal arm 310, and is off set from the centerline of the pentagonal arm 310 on the opposite side to the output shaft 301*a*. When the output shaft is rotated, the pentagonal arm 310 pushes up or pulls down the connecting rod 311. The arm 312 is rotatably connected to a pin 320. The arm 312 has three portions 312*a*/312*b*/312*c*, which are different in distance from the pin 320 from one another. The portion 312*a* is longer than the portion 312*c*, but is shorter than the portion 312*b*. The connecting rod 311 is turnably connected to the portion 312*a*. The connecting rod 311 gives rise to bidirectionally rotate the arm 312 around the pin 320. Accordingly, the other portions 312*b*/312*c* are bidirectionally rotated around the pin 320.

Figure 7:
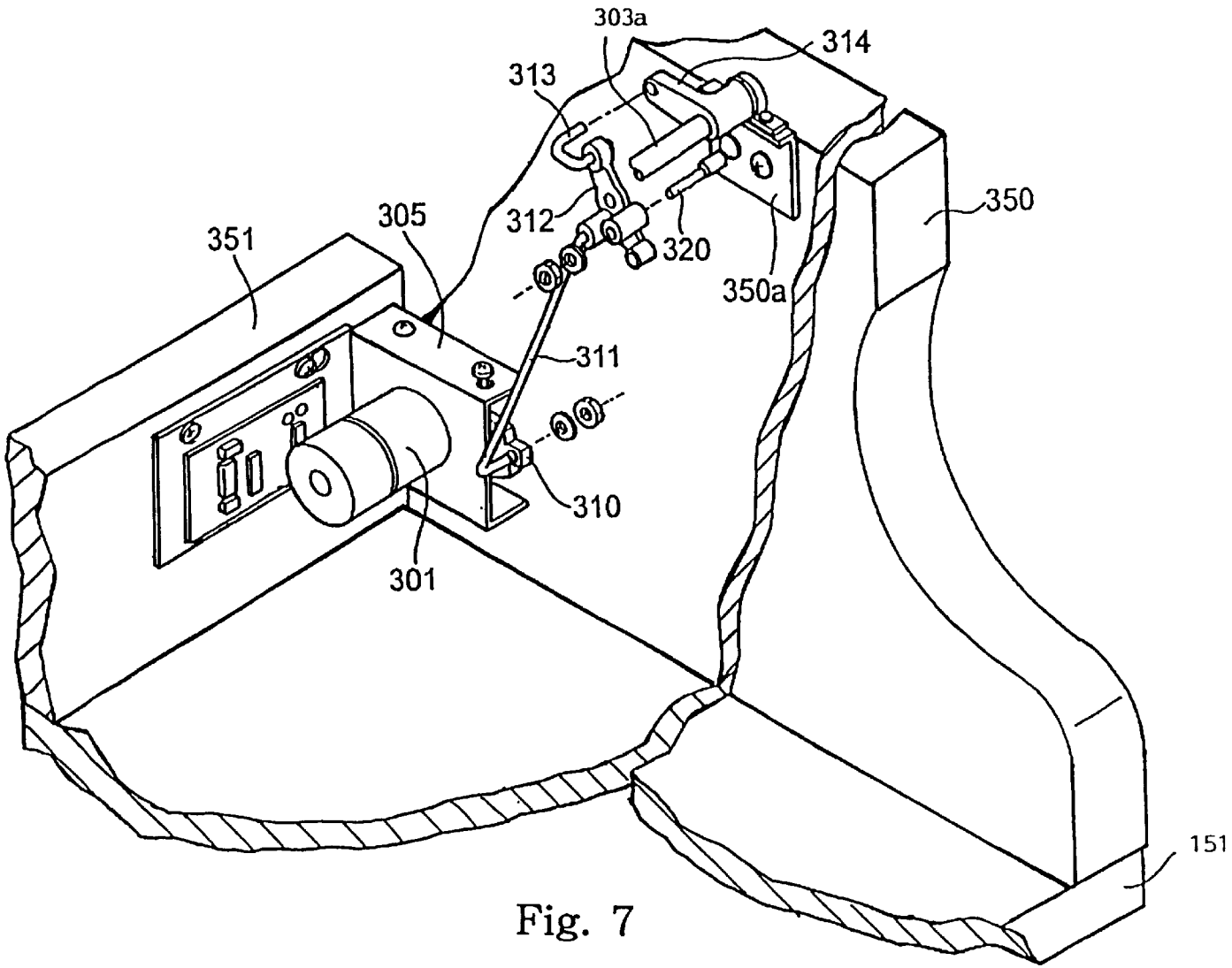
FIG. 7 is a perspective view showing the arrangement of a connection between a link work and an electric motor in disassembled state.
Figure 8:
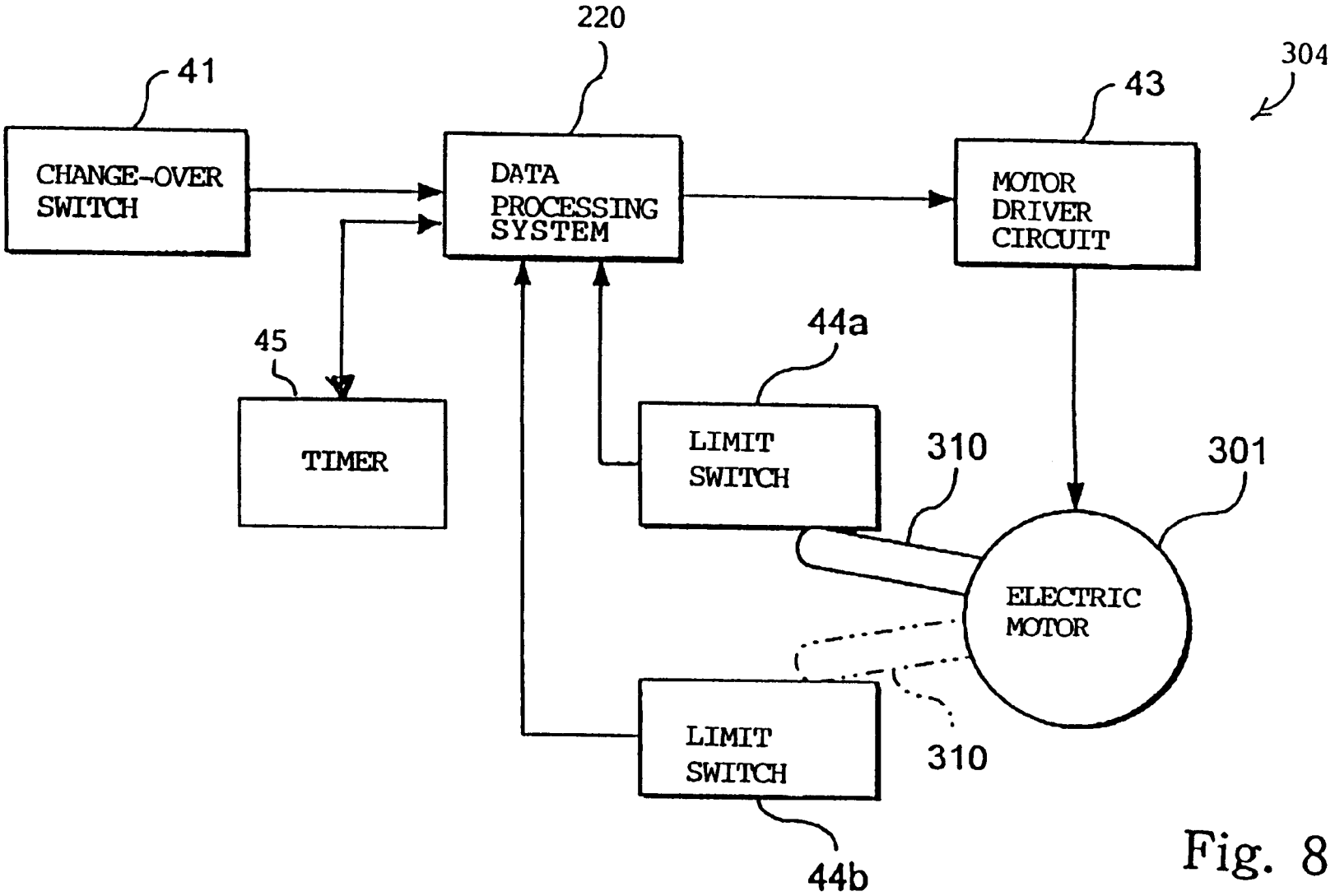
FIG. 8 is a block diagram showing a circuit configuration in the silent system.

The link sub-work 302*b* includes a connecting rod 313 and an arm 314. The connecting rod 313 is connected at one end thereof to the portion 312*b* of the arm 312, and the arm 314 is fixed at one end thereof to the shaft 303*a* of the hammer stopper 303. The arm 314 is located at the rightmost portion of the shaft 303*a* as shown in FIG. 7. The other end of the connecting rod 313 is turnably connected to the other end of the arm 314. The portion 312*b* pushes or pulls the connecting rod 313, and the connecting rod 313 gives rise to the rotation of the arm 314 and, accordingly, the shaft 303*a*. Thus, the rotation of the output shaft 301*a* is transmitted through the common link subwork 302*a* and the link subwork 302*b* to the shaft 303*a*.

The other link sub-work 302*c* includes arms 333/334/335/338, a receiver 336, a connecting rod 337 and a spring 339. The arm 333 is rotatably supported at the lower end thereof by a suitable bracket (not shown), which may be fixed to the inner surface of the right side board 350. The upper end of the arm 333 is turnably connected to the lower end of the arm 334. The upper end of the arm 334 is fixed to the lower end of the arm 335, and is turnably connected to one end of the connecting rod 337. The receiver 336 is fixed to the upper end of the arm 335, and has a flat surface 336*a* opposed to the portion 312*c* of the arm 312. The spring 339 urges the arms 333 and 334 to keep the attitude shown in FIG. 6. Although the elastic force is exerted on the arms 333/334 at all times, the receiver 336 does not give rise to rotation of the arm 312 in the counter clockwise direction, because the geared motor 301 has the large self-holding capability by virtue of the high gear ratio.

The electric motor 301 is assumed to give rise to the rotation of the arm 312 in the clockwise direction. The portion 312*c* pushes the receiver 336, and gives rise to the rotation of the arms 333/334. The connecting rod 337 is pushes the arm 338, and gives rise to the rotation of the arm 338 and, accordingly, the shaft 223*a* in the counter clockwise direction around the center axis of the shaft 223*a*. The second regulating button 223 is changed from the inactive position to the active position.

The link work 302 is constituted by arms 310, 312, 314, 333, 334, 335 and 338 and the connecting rods 311, 313 and 337. The arms 310, 312, 314, 333, 334, 335 and 338 and the connecting rods 311, 313 and 337 are formed of metal, alloy, synthetic resin or wood, and are considered to be rigid against the force transmitted from the output shaft 301*a* to the shafts 303*a*/223*a*. For this reason, only a negligible amount of time lug is introduced between the rotation of the output shaft 301*a* and the rotation of the shaft 303*a*/223*a*. Thus, the link work 302 promptly transmits the force from the electric motor 301 to the hammer stopper/second regulating button 303/223.

Turning to FIG. 7, the controller 304 includes the data processing system 220, a mode switch 41, a motor driver circuit 43, limit switches 44*a*/44*b* and a timer 45. The mode switch 41 and the data processing system 220 are shared between the electronic sound generating system 200 and the silent system 300. The mode switch 41 is, by way of example, attached to the back surface of the key bed 151 in the vicinity of the pianist sitting in front of the keyboard 110. The mode switch 41 is connected to a signal input port of the data processor. When the pianist manipulates the mode switch 41 for changing the composite keyboard musical instrument between the acoustic sound mode and the silent mode, the mode switch 41 supplies an instruction signal representative of the acoustic sound mode or the silent mode to the data processor. The limit switches 44*a*/44*b* are provided in the trajectory of the pentagonal arm 310, and are spaced from each other by a predetermined angle. The limit switches 44*a*/44*b* are, by way of example, implemented by mechanical switches, and are connected to the signal input port of the data processor. When one of the limit switches 44*a*/44*b* detects the arm 310 entering a detectable range, the limit switch 44*a* or 44*b* supplies a detecting signal representative of the arrival of the arm 310 to the data processor. The timer 45 is implemented by a counter. However, the timer 45 may be implemented by a computer program. When the data processor instructs the motor driver circuit 43 to supply the electric power to the electric motor 301, the timer 45 is reset, and starts incrementing the value stored therein. The data processor periodically fetches the output signal of the timer representative of the lapse of time from the reset. A reference time period is stored in the working memory, and is equal to the lapse of time consumed by the pentagonal arm 310 during the travel between the limit switches 44*a* and 44*b*. The data processor compares the lapse of time with the reference time period to see whether or not the detecting signal reaches the signal input port of the data processor within the reference time period. If the detecting signal reaches the signal input port within the reference time period, the data processor instructs the motor drive circuit 43 to stop the electric power on the basis of the detecting signal. However, the limit switch 44*a* or 44*b* is troubled. Any detecting signal is supplied from the limit switch 44*a*/44*b* to the signal input port of the data processor, and the lapse of time becomes equal to the reference time period. Then, the data processor instructs the motor driver circuit 43 to stop the electric power without the detecting signal. Thus, the timer 45 is provided for the sake of safety.

The data processor periodically checks the signal input port to see whether or not any one of the switches 41/44*a*/44*b* changes the output signal thereof. When the pianist changes the mode switch 41 between the acoustic sound mode and the silent mode, the data processor instructs the motor driver circuit 43 to energize the electric motor 301. The electric motor 301 rotates the output shaft 301*a*, and the arm 310 travels from one of the limit switches 44*a*/44*b* to the other limit switch 44*b*/44*a*. The link work 302 changes the hammer stopper 303 between the blocking position and the free position and the second regulating button 223 between the active position and the inactive position. While the arm is traveling from the limit switch 44*a*/44*b* to the other limit switch 44*b*/44*a*, the detecting signals are not changed, and the motor driver circuit 43 continuously supplies the electric power to the electric motor 301. When the arm 310 reaches the associated limit switch 44*a*/44*b*, the detecting signal is supplied to the data processor, and the data processor instructs the motor driver circuit 43 to stop the electric power.

Description is hereinbelow made on the behavior of the composite keyboard musical instrument in detail. Assuming now that a pianist wishes to play a tune on the keyboard 110 in the acoustic sound mode, the pianist manipulates the mode switch 41 so as to give an instruction representative of the acoustic sound mode to the data processor 220, and the silent system 300 sets the composite keyboard musical instrument ready for performance in the acoustic sound mode. In the following description, terms "clockwise direction" and "counter clockwise direction" are determined in the link work 302 shown in FIGS. 5 and 6 or the acoustic grand piano shown in FIG. 4.

In detail, when the pianist manipulates the mode switch 41, the mode switch 41 produces the instruction signal representative of the acoustic sound mode, and the instruction signal is supplied from the mode switch 41 to the signal input port of the data processor. The data processor discriminates the instruction, and instructs the motor driver circuit 43 to supply the electric power to the electric motor 301 for rotating the output shaft 301*a* in the clockwise direction.

The electric motor 301 rotates the output shaft 301*a* in the clockwise direction, and gives rise to angular motion of the pentagonal arm 310. The pentagonal arm 310 leaves the limit switch 44*b*, and travels toward the other limit switch 44*a*. The pentagonal arm 310 pushes up the connecting rod 311, and the arm 312 is driven for rotation in the counter clockwise direction around the pin 320. The portion 312*b* leftward exerts the force on the arm 314 through the connecting rod 313. This results in the rotation of the arm 314 and, accordingly, the shaft 303*a* in the clockwise direction around the center axis of the shaft 303*a*. The laminations of the artificial leather sheets 303*c* are moved out of the trajectories of the hammers 130.

The other portion 312*c* is also rotated in the counter clockwise direction around the pin 320, and leaves from the receiver 336. The spring 339 urges the arms 333/334 rightward, and pulls the connecting rod 337. The connecting rod 337 gives rise to the rotation of the arm 338 in the clockwise direction, and the shaft 223*a* is also rotated in the clockwise direction. Accordingly, the second regulating button 223 is moved out of the trajectory of the bump 12B*b*.

When the limit switch 44*a* detects the pentagonal arm 310 arriving thereat, the limit switch 44*a* produces the detecting signal, and supplies it to the signal input port of the data processor. The data processor acknowledges the hammer stopper 303 and the second regulating button 12B*b* to be in the free position and in the inactive position. Then, the data processor instructs the motor driver circuit 43 to stop the electric power. As a result, the electric motor 301 stops the output shaft 301*a*, and the link work 302 keeps the hammer stopper 303 and the second regulating button 12B*b* in the free position and the inactive position. Thus, the limit switches 44*a*/44*b* render the mode change sure. In other words, the controller 304 prohibits the hammer stopper 303 and the second regulating button 12B*b* from stopping on the way to the free position and the inactive position.

When the composite keyboard musical instrument is set in the acoustic sound mode, the pianist starts playing a tune on the keyboard 110. The black/white keys 10 are selectively depressed and released along the notes on the music score. When the pianist depresses a black/white key 10, the depressed key 10 gives rise to the rotation of the whippen 11 in the clockwise direction around the whippen flange. The associated hammer 130 is forcibly rotated around the shank flange 19 in the counter clockwise direction, and the toe 12B*a* is getting closer to the regulating button 23 without rotation of the jack 12 around the whippen. When the toe 12B*a* is brought into contact with the regulating button 23, the jack 12 quickly turns around the whippen 11 in the counter clockwise direction, and escapes from the associated hammer 130. When the jack 12 escapes from the hammer 130, the jack 12 kicks the hammer roller 22, and the hammer 130 starts the free rotation toward the associated sets of strings 140. The hammer head 20 strikes the sets of strings 140, and the set of strings 140 vibrates for generating the acoustic piano tone. The hammer head 20 is received by the back check, and the hammer roller 22 is brought into contact with the jack 12, again. When the pianist releases the depressed key 10, the rear portion of the black/white key 10 permits the whippen 11 to be rotated in the counter clockwise direction due to the self-weight, and the back check is separated from the hammer head 20. Thus, the black/white key 10, the action mechanism 120 and the hammer 130 return to the initial positions. While the pianist is playing the tune on the keyboard, the black/white keys 10, the action mechanisms 120 and the hammers 130 repeats the above-described sequence so as to generate the acoustic piano tones.

On the other hand, if the pianist wishes to practice the fingering without the acoustic piano tone, the pianist changes the mode switch 41 to the silent mode. The mode switch 41 produces the instruction signal representative of the silent mode, and supplies it to the signal input port of the data processor. The data processor discriminates the instruction, and instructs the motor driver circuit 43 to supply the electric power to the electric motor 301 for rotating the output shaft 301*a* in the counter clockwise direction.

The electric motor 301 rotates the output shaft 301*a* in the counter clockwise direction, and gives rise to angular motion of the pentagonal arm 310. The pentagonal arm 310 leaves the limit switch 44*a*, and travels toward the other limit switch 44*b*. The pentagonal arm 310 pulls down the connecting rod 311, and the arm 312 is driven for rotation in the clockwise direction around the pin 320. The portion 312*b* rightward exerts the force on the arm 314 through the connecting rod 313. This results in the rotation of the arm 314 and, accordingly, the shaft 303*a* in the counter clockwise direction around the center axis of the shaft 303*a*. The laminations of the artificial leather sheets 303*c* are moved into the trajectories of the hammers 130.

The other portion 312*c* is also rotated in the clockwise direction around the pin 320, and is brought into contact with the receiver 336. The other portion 312*c* pushes the receiver 336 against the elastic force of the spring 339, and pushes the connecting rod 337 leftward. The connecting rod 337 gives rise to the rotation of the arm 338 in the counter clockwise direction, and the shaft 223*a* is also rotated in the counter clockwise direction. Accordingly, the second regulating button 223 is directed to the bump 12B*b*, and is moved into the trajectory of the bump 12B*b*.

When the limit switch 44*b* detects the pentagonal arm 310 arriving thereat, the limit switch 44*b* produces the detecting signal, and supplies it to the signal input port of the data processor. The data processor acknowledges the hammer stopper 303 and the second regulating button 12B*b* to enter the blocking position and in the active position. Then, the data processor instructs the motor driver circuit 43 to stop the electric power. As a result, the electric motor 301 stops the output shaft 301*a*, and the link work 302 keeps the hammer stopper 303 and the second regulating button 12B*b* in the blocking position and the active position. Thus, the limit switches 44*a*/44*b* render the mode change to the silent mode sure. In other words, the controller 304 prohibits the hammer stopper 303 and the second regulating button 12B*b* from stopping on the way to the blocking position and the active position.

When the composite keyboard musical instrument is set to the silent mode, the pianist starts playing the tune on the keyboard 110. The black/white keys 10, the action mechanisms 120 and the hammers 130 behave as similar to those in the acoustic sound mode except escape and rebound on the hammer stopper 303. In detail, while the pianist is depressing the black/white key 10, the depressed key 10 gives rise to the rotation of the whippen 11 in the clockwise direction around the whippen flange. Since the second regulating button 12B*b* is in the active position, the bump 12B*b* is brought into contact with the second regulating button 223 before the toe 12B*a*, and the reaction gives rise to the rotation of the jack 12 in the counter clockwise direction around the whippen 11. Then, the jack 12 escapes from the hammer 130, and the hammer 130 starts the free rotation. The escape in the silent mode is earlier than the escape in the acoustic sound mode so that the hammer shank 21 is never pinched between the jack 12 and the hammer stopper 303. The hammer 21 is brought into contact with the lamination of artificial leather sheets 303*c* before the strike at the sets of strings 140. The hammer 130 rebounds on the hammer stopper 303, and is backward rotated. For this reason, the set of strings 140 does not vibrate, and any acoustic piano tone is never generated from the set of strings 140. Instead, the electronic sound generating system 200 generates an electronic tone corresponding to the acoustic piano tone. The key sensors 215 monitors the associated black/white keys 10, and supplies the key position signals representative of the current key positions to the signal input port of the data processor. Similarly, the hammer sensors 210 monitor the associated hammers 130, and supplies the hammer position signals representative of the current hammer positions to the signal input port of the data processor. The data processor periodically checks the signal input port to see whether or not any black/white key 10 changes the current key position and whether or not any hammer 130 changes the current hammer position. If the current key position is changed, the pianist depresses or releases the black/white key 10. The data processor specifies the depressed/released key 10, and rewrites the piece of key data information stored in the working memory. When the depressed key 10 gives rise to the escape, the hammer starts the free rotation, and the current hammer position is varied together with time. The data processor calculates the final hammer velocity or the loudness of the electronic tone to be generated on the basis of the variation of the current hammer position. When the hammer 130 reaches a predetermined position on the trajectory, the data processor generates a MIDI message representative of the note-on at the loudness for the depressed key 10, and supplies the MIDI message to the tone generator 230. The tone generator produces the audio signal from the MIDI message, and supplies the audio signal to the headphone 241 of the sound system 240. After rebounding on the hammer stopper 303, the pianist releases the depressed key 10. The black/white key 10 starts returning to the rest position, and the key sensor 215 continuously reports the current key position to the signal input port of the data processor. When the black/white key 10 passes a predetermined point on the trajectory, the data processor generates another MIDI message representative of the note-off for the electronic tone. The MIDI message is supplied from the data processor to the tone generator 230, and the tone generator 230 decays the audio signal. Accordingly, the electronic tone is decayed.

As will be appreciated from the foregoing description, the limit switches 44*a*/44*b* detect the arm 310 arriving at the positions corresponding to the free/blocking positions, and the data processor instructs the motor driver circuit 43 to stop the electric power in response to the detecting signals. The hammer stopper 303 never stops on the way to the free/blocking position. Thus, the limit switches 44*a*/44*b* prevents the composite keyboard musical instrument from damage due to the hammer stopper 303 at the intermediate position between the free position and the blocking position.

Moreover, the actuator, i.e., the electric motor 301 is connected to the hammer stopper 303 and the second regulating button 223 by means of the rigid link work 302. Although the flexible wire 4 tends to be elongated due to the force exerted thereon, the link work 302 is less deformed, and promptly transmits the force from the actuator 301 to the hammer stopper/second regulating button 303/223 without substantial time lug. This feature is desirable, because the pianist can change the composite keyboard musical instrument between the acoustic sound mode and the silent mode, i.e., the acoustic piano tones and the electronic tones at any timing during the performance. Thus, the pianist can take the adequate expression in the performance. The timer 45 enhances the reliability of the silent system 300.

In the first embodiment, the sets of strings 140 serve as plural vibratory members, and the action mechanisms 120 and the associated hammers 130 as a whole constitute plural vibration generating mechanisms.

Second Embodiment

Figure 9:
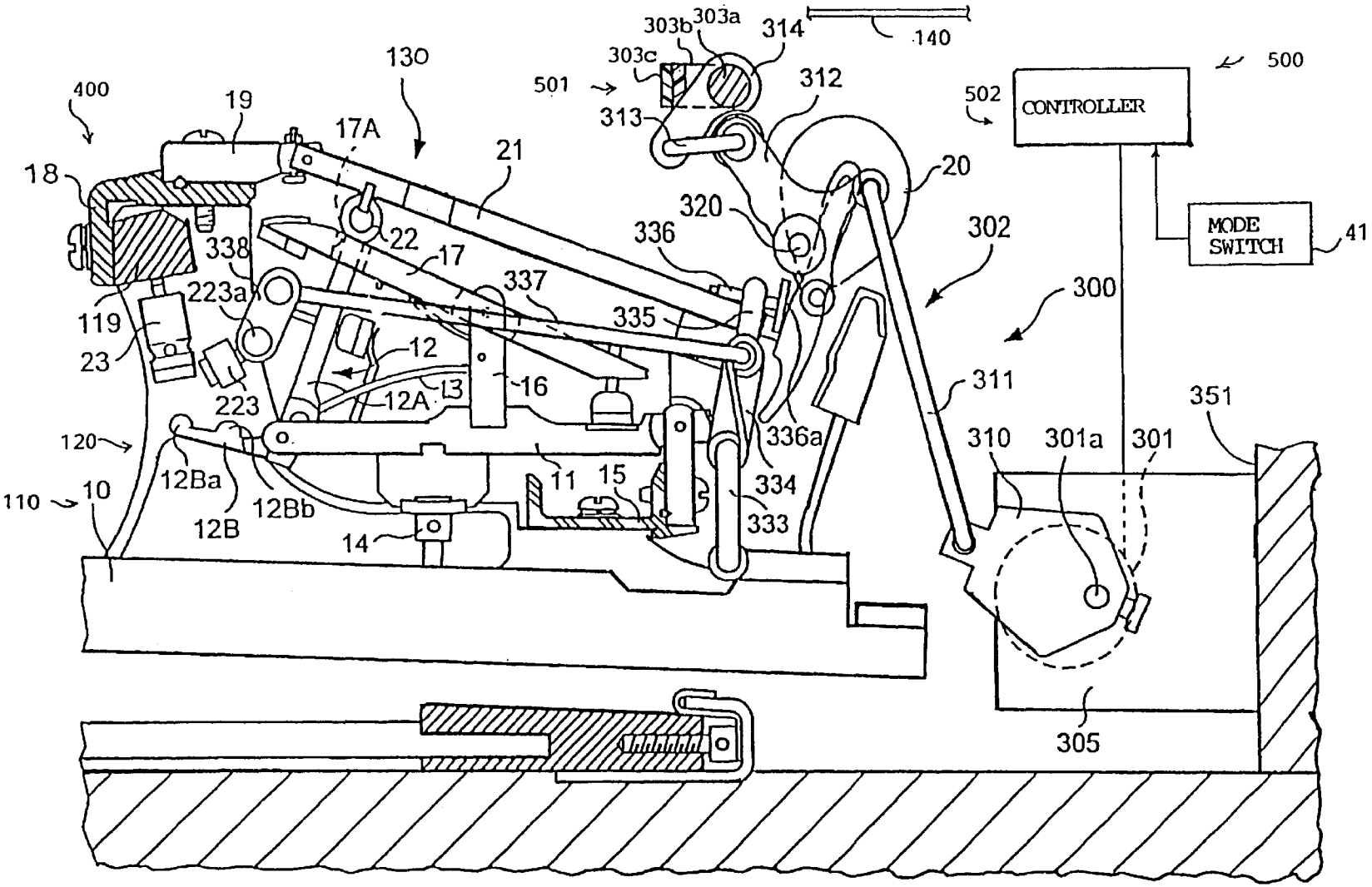
FIG. 9 is a side view showing another composite keyboard musical instrument according to the present invention.

Turning to FIG. 9 of the drawings, another composite keyboard musical instrument largely comprises an acoustic grand piano 400 and a muting system 500. The acoustic grand piano 400 is similar in structure to the acoustic grand piano 100, and description is omitted for avoiding repetition.

The muting system 500 includes the electric motor 301, the mode switch 41, a hammer stopper 501 and a controller 502. The electric motor 301 and the mode switch 41 are similar to those forming parts of the silent system 300. The hammer stopper 501 is similar in structure to the hammer stopper 303, and component parts are labeled with the same references designating the corresponding component parts of the hammer stopper 303. The difference between the hammer stoppers 303 and 501 is the position in the piano case. The hammer stopper 501 is changed between a free position and a muting position. When the hammer stopper 501 is changed to the muting position, the laminations of the artificial leather sheets 303*c* are positioned in such a manner that the hammers 130 gently strike the associated sets of strings 140. For this reason, the sets of strings 140 vibrate for generating faint tones.

The controller 502 is corresponding to the data processing system 220 and the motor driver circuit 43. The controller 502 is responsive to the instruction signal supplied from the mode switch 41, and controls the electric power supplied to the electric motor 301.

The composite keyboard musical instrument implementing the second embodiment achieves all the advantages of the first embodiment. Moreover, the composite keyboard musical instrument implementing the second embodiment does not require any electronic sound generating system 200, because the faint piano tones are produced from the sets of strings 140. Thus, the composite keyboard musical instrument is simpler than the first embodiment, and is economical.

Although particular embodiments of the present invention have been shown and described, it will be apparent to those skilled in the art that various changes and modifications may be made without departing from the spirit and scope of the present invention.

The mode switch 41 may be provided on a manipulating panel of a remote controller. Otherwise, the mode switch may be provided on a manipulating panel of an external controller connected through a cable to a terminal provided in the composite keyboard musical instrument.

The limit switches 44*a*/44*b* may be implemented by photo-couplers or another kind of non-contact switches.

The data processing system 220 may be communicable with the motor driver circuit 43 through wireless communication technologies.

The electric motor 301 may be replaced with a solenoid-operated actuator. Otherwise, the arm 310 may be driven for rotation by means of a pneumatic actuator or a hydraulic actuator controlled through an electromagnetic valve.

A feed-forward control may be employed in the silent system 300. For example, the electric motor 301 is replaced with a stepping motor, and the data processing system 220 instructs a pulse generator to supply a predetermined number of pulses to the stepping motor.

The limit switches 44*a*/44*b* may be provided in association with another arm or connecting rod. The parts of the link work 302 is so rigid that the limit switches 44*a*/44*b* can exactly determine the range of motion.

The electronic sound generating system 200 may be deleted from the composite keyboard musical instrument implementing the first embodiment, and may be added to the composite keyboard musical instrument implementing the second embodiment.

The present invention is applicable to another kind of acoustic keyboard musical instrument such as, for example, an upright piano, a harpsichord and a celesta.

The second regulating button 223 and the link sub-work 302*c* may be deleted from the silent system in so far as there is little possibility that the hammer shank 21 is pinched between the hammer stopper 303 and the jack 12. A composite keyboard musical instrument is fabricated on the basis of an upright piano. The possibility may be little.

What is claimed is:

1. A keyboard musical instrument comprises an acoustic keyboard musical instrument including a keyboard consisting of plural keys, plural vibratory members vibrating for generating acoustic tones respectively assigned notes of a scale, plural vibration generating mechanisms respectively provided between said plural keys and said plural vibratory members and responsive to motions of said plural keys for generating vibrations in said plural vibratory members and a case accommodating said plural vibratory members and said plural vibration generating mechanisms and providing said keyboard to a player, and a silent system including an actuator generating a power, a stopper changed between a free position for allowing said plural vibration generating mechanisms to generate said vibrations in said plural vibratory members and a blocking position for preventing said plural vibratory members from said plural vibration generating mechanisms and an interconnection connected between said actuator and said stopper and rigid against said power so as to promptly transmit said power from said actuator to said stopper without substantial deformation thereof.

2. The keyboard musical instrument as set forth in claim 1, in which said each of said vibration generating mechanisms includes a hammer rotatable for striking one of said plural vibratory members and an action mechanism provided between one of said plural keys and said hammer and escaping from said hammer so as to give rise to rotation of said hammer toward one of said plural vibratory members.

3. The keyboard musical instrument as set forth in claim 2, in which said one of said plural vibratory members is a set of strings.

4. The keyboard musical instrument as set forth in claim 3, in which said set of strings, said hammer and said action mechanism form parts of an acoustic piano.

5. The keyboard musical instrument as set forth in claim 2, in which said action mechanism includes a whippen rotatably supported at one end thereof by a member stationary with respect to said case, a regulating button supported by another member stationary with respect to said case and a jack rotatably supported by the other end of said whippen and brought into contact with said regulating button in a downward motion of associated one of said plural keys for rotating said hammer through the escape.

6. The keyboard musical instrument as set forth in claim 2, in which said action mechanism includes a whippen rotatably supported at one end thereof by a member stationary with respect to said case, a first regulating button supported by another member stationary with respect to said case, a second regulating button supported by yet another member stationary with respect to said case and changed between an active position and an inactive position by said interconnection, said second regulating button being changed to said active position concurrently with said stopper changed to said blocking position, said second regulating button being changed to said inactive position concurrently with said stopper changed to said free position, and a jack rotatably supported by the other end of said whippen and having a toe spaced from said first regulating button by a first distance and a bump spaced from said second regulating button in said active position by a second distance shorter than said first distance, said toe and said bump are selectively brought into contact with said regulating button and said second regulating button in a downward motion of associated one of said plural keys for rotating said hammer through the escape.

7. The keyboard musical instrument as set forth in claim 6, in which said stopper and said second regulating button are respectively connected to a first link sub-work and a second link sub-work, and said actuator is connected through a third link sub-work to said first and second link sub-works.

8. The keyboard musical instrument as set forth in claim 7, in which one of said first, second and third link sub-works is monitored by a pair of position transducers for stopping said actuator when said stopper and said second regulating button are changed between said free position and said blocking position and between said inactive position and said active position, respectively.

9. The keyboard musical instrument as set forth in claim 8, further comprising an electronic sound generating system for generating electronic tones instead of said acoustic tones.

10. The keyboard musical instrument as set forth in claim 1, in which said actuator is implemented by an electric motor.

11. The keyboard musical instrument as set forth in claim 10, in which said stopper is provided in an upper portion of a rear space in said case, and said electric motor is provided in a side zone of a lower portion of said rear space.

12. The keyboard musical instrument as set forth in claim 1, in which said interconnection includes plural links connected between said actuator and said stopper.

13. The keyboard musical instrument as set forth in claim 1, in which said silent system further includes a controller connected to said actuator and a pair of position transducers monitoring said interconnection moved between a first position corresponding to said free position and a second position corresponding to said blocking position and supplying a first detecting signal at said first position and a second detecting signal at said second position to said controller so as to stop said actuator when said stopper reaches said free position and said blocking position.

14. The keyboard musical instrument as set forth in claim 13, in which said silent system further includes a timer measuring a lapse of time consumed by said interconnection moved between said first position and said second position, and said controller stops said actuator without said first and second detecting signals when said lapse of time exceeds a critical time period to be consumed by said interconnection without any trouble.

15. The keyboard musical instrument as set forth in claim 14, further comprising an electronic sound generating system for generating electronic tones instead of said acoustic tones.

16. The keyboard musical instrument as set forth in claim 1, in which each of said vibration generating mechanisms includes a first stationary member stationary with respect to said case, a second stationary member stationary with respect to said case, a movable member moved together with one of said plural keys and brought into contact with said first stationary member when said stopper is in said free position and said second stationary member when said stopper is in said blocking position so as to actuate associated one of said plural vibratory members for generating said vibrations.

17. The keyboard musical instrument as set forth in claim 16, in which said second stationary member is changed between an active position together with said stopper changed to said blocking position and an inactive position together with said stopper changed to said free position by means of said interconnection.

18. The keyboard musical instrument as set forth in claim 17, in which said interconnection has a first link sub-work connected to said stopper, a second link sub-work connected to said second stationary member and a third link sub-work connected between said actuator and said first and second subworks.

19. The keyboard musical instrument as set forth in claim 18, in which said silent system further includes a pair of position transducers monitoring one of said first, second and third link sub-works and supplying a first detecting signal at a first position corresponding to said free position and a second detecting signal at a second position corresponding to said blocking position and a controller connected to said actuator and said pair of position transducers and responsive to an instruction for supplying an energy to said actuator and to said first and second detecting signals for stopping said energy.

20. The keyboard musical instrument as set forth in claim 19, in which said silent system further includes a timer measuring a lapse of time consumed by said one of said first, second and third link sub-works moved between said first position and said second position, and said controller stops said energy without said first and second detecting signals when said lapse of time exceeds a critical time period to be consumed by said one of said first, second and third link sub-works without any trouble.

21. The keyboard musical instrument as set forth in claim 8, further comprising an electronic sound generating system for generating electronic tones instead of said acoustic tones.

22. A keyboard musical instrument comprises an acoustic keyboard musical instrument including a keyboard consisting of plural keys, plural vibratory members vibrating for generating acoustic tones respectively assigned notes of a scale, plural vibration generating mechanisms respectively provided between said plural keys and said plural vibratory members and responsive to motions of said plural keys for generating vibrations in said plural vibratory members and a case accommodating said plural vibratory members and said plural vibration generating mechanisms and providing said keyboard to a player, and a muting system including an actuator generating a power, a stopper changed between a free position for allowing said plural vibration generating mechanisms to generate said vibrations in said plural vibratory members and a muting position for reducing forces exerted on said plural vibratory members by said plural vibration generating mechanisms and an interconnection connected between said actuator and said stopper and rigid against said power so as to promptly transmit said power from said actuator to said stopper without substantial deformation thereof.

23. The keyboard musical instrument as set forth in claim 22, in which each of said vibration generating mechanisms includes a first stationary member stationary with respect to said case, a second stationary member stationary with respect to said case, a movable member moved together with one of said plural keys and brought into contact with said first stationary member when said stopper is in said free position and said second stationary member when said stopper is in said blocking position so as to actuate associated one of said plural vibratory members for generating said vibrations.

24. The keyboard musical instrument as set forth in claim 23, in which said second stationary member is changed between an active position together with said stopper changed to said blocking position and an inactive position together with said stopper changed to said free position by means of said interconnection.

25. The keyboard musical instrument as set forth in claim 24, in which said interconnection has a first link sub-work connected to said stopper, a second link sub-work connected to said second stationary member and a third link sub-work connected between said actuator and said first and second sub-works.

26. The keyboard musical instrument as set forth in claim 25, in which said silent system further includes a pair of position transducers monitoring one of said first, second and third link sub-works and supplying a first detecting signal at a first position corresponding to said free position and a second detecting signal at a second position corresponding to said blocking position and a controller connected to said actuator and said pair of position transducers and responsive to an instruction for supplying an energy to said actuator and to said first and second detecting signals for stopping said energy.

27. The keyboard musical instrument as set forth in claim 26, in which said silent system further includes a timer measuring a lapse of time consumed by said one of said first, second and third link sub-works moved between said first position and said second position, and said controller stops said energy without said first and second detecting signals when said lapse of time exceeds a critical time period to be consumed by said one of said first, second and third link sub-works without any trouble.

28. The keyboard musical instrument as set forth in claim 8, further comprising an electronic sound generating system for generating electronic tones instead of said acoustic tones.

* * * * *